United States Patent [19]

Prouhet

[11] 3,999,633

[45] Dec. 28, 1976

[54] PRESSURE DEVICE FOR APPLYING A BAND AGAINST A DRIVING OR BRAKING CYLINDER

[75] Inventor: Jacques François Robert Prouhet, Les-Clayes-sous-Bois, France

[73] Assignees: Societe de Constructions Mecaniques de Creil (COMEC), Creil; Bertin & Cie, Plaisir, both of France

[22] Filed: June 16, 1975

[21] Appl. No.: 586,937

[30] Foreign Application Priority Data

June 20, 1974 France ..... 74.21416

[52] U.S. Cl. ..... 188/64; 188/74; 188/259

[51] Int. Cl.[2] ..... F16D 49/14

[58] Field of Search ..... 188/1 R, 64, 65.1, 74, 188/151 R, 259

[56] References Cited

UNITED STATES PATENTS 2,252,741 8/1941 Thornburg ..... 188/65.1 X 3,116,897 1/1964 Theed ..... 188/5 X 3,430,738 3/1969 Dain et al. ..... 188/259 X

*Primary Examiner*—Duane A. Reger

*Attorney, Agent, or Firm*—A. W. Breiner

[57] ABSTRACT

The invention relates to a band pressing shoe. Such shoe includes a rigid body to which is attached a thin flexible and inextensible strip. When the rigid body is subjected to a pressing thrust, the strip assumes an arcuate shape and tautens. Between the strip and the band are interposed one or more fluid cushions supplied from a manifold through an elastic mattress made of a cellular material. The pressing shoe can be supplied in all cases where it is required to drive or restrain a band running over a cylinder (e.g. a roller, drum, pulley or the like), examples being conveyor belts, transmission belts, metal strips undergoing splitting, planing or coiling, and so forth.

8 Claims, 10 Drawing Figures

P
Y
Y'
6
11
16
12
10
14
35
4
20a
7
13
58
57
56
62
59
60
52
54
51
55
53
20
73
74
75
72
71
3b
65
70
50
64
8

PRESSURE DEVICE FOR APPLYING A BAND AGAINST A DRIVING OR BRAKING CYLINDER

This invention relates to a device for pressing a band against the outer surface of a band driving or braking cylinder, said band having an active face in contact with the cylinder along a circumferential arc thereof, and a free opposite face.

Such device is applicable in all cases where it is required to drive or brake a band running over a cylinder such as a roller, drum, pulley or the like, for example in installations which include conveyor belts or transmission belts, but is particularly advantageous to the metallurgical industry in the ultimate manufacturing stages (e.g. splitting, planing or coiling) of rolled products.

Setting a band under tension by means of a braking or driving cylinder is manifestly possible only if the band which is running past has sufficient adhesion against such a cylinder. Recourse is frequently had to devices for pressing the band against the outer surface of the cylinder in order to increase or bring about such adhesion.

However, in order to prevent the direct contact of a pressure member against the band from damaging the latter, it is known in the prior art (e.g. French Pat. No. 1,504,598 and U.S. Pat. No. 3,381,541 to Thireau et al.) to interpose, between said pressure member and the band, at least one fluid cushion such as an air cushion.

The present invention belongs to this family of pressure devices well-known per se, which include:

- a pressure shoe located opposite a portion of the free face of the band (i.e. the face not in contact with the cylinder) and separated therefrom by a narrow gap, said shoe comprising a rigid body;
- means for injecting into said gap fluid from a pressurized fluid source whereby to generate at least one fluid cushion therein;
- and means for subjecting said rigid body to a thrust directed towards said free band face whereby to press the band against the outer surface of the cylinder.

The pressing thrust exerted against the rigid body of the pressure shoe is thus transmitted to the band through the said fluid cushion.

Pressure devices of known types include rigid shoes, and their operation is satisfactroy provided that the free face of the band is smooth and exhibits no surface unevennesses such as depressions, protrusions or ripples. If such free surface exhibits unevennesses, then either there is a danger of shocks causing erosion of the shoe and the band or else a large gap must be provided therebetween that results in fluid flow rates and hence expenditures of energy usually incompatible with the object sought.

In order to overcome this drawback it has been proposed to interpose, between the fluid cushion and the rigid body of the shoe, suspension means possessed of suitable elasticity and damping properties capable of absorbing said unevenesses, in conjunction with the use of a narrow gap, in which case the cushion is supplied with pressurized fluid through deformable conduits. It has been proposed, for example, to employ by way of such suspension means a mattress made of elastically deformable cellular material such as rubber or elastomer foam, through the thickness of which are formed one or more fluid passageways for feeding the cushion.

However, the durability in service of a mattress of this kind has proved unsatisfactory. Indeed the mattress is continuously subjected to substantial crushing since the pressing thrust is transmitted to the fluid cushion through it and thereafter to the band. Now such crushing is detrimental to the cellular material because the gas in the cells, being set under pressure as a result of the crushing, escapes to the exterior because the walls of the cells are very thin and consequently porous. It has been found, for instance, that crushing the mattress by 25% of its thickness was already sufficient to seriously damage the material.

Broadly speaking, the present invention has for its object to provide a band pressing device of the fluid cushion type, in which the disadvantages stemming from either the absence of suspension means or the use of an intermediate mattress functioning under continuous compression are overcome.

In accordance with this invention, in a band pressing device of the aforesaid kind, the pressure shoe included a flexible strip supported by two ends of the rigid body of said shoe and having, opposite the said free band face portion, an active section separated from said free-face portion by the cushion space and possible elastic damping means cooperating with both said flexible tape and said rigid shoe whereby, when said rigid body is subjected to the pressing thrust, the active strip section matches its arcuate shape to that of said free portion of the band face at the same time as said flexible strip as a whole tautens. Again in accordance with this invention, the means for injecting cushion fluid include at least one fluid passageway formed through said active strip section and enabling fluid from the pressurized-fluid source to be injected into said cushion gap.

In a pressure device according to this invention, most if not all of the continuous pressure thrust exerted against the rigid body of the shoe is transmitted to the band through a flexible strip working under tension rather than through an elastic mattress working under compression. Such flexible strip and the elastic damping means possibly associated thereto are additionally capable of absorbing, at least partly, the band surface unevennesses referred to precedingly.

Supplying fluid to the cushion gap requires one or more flexible conduits for communicating the active section of the flexible strip with the rigid body of the shoe. Such conduits may consist of one or more rubber tubes of appropriate shape such as a bellows shape, of a layer of elastomer formed with holes therethrough, or, in accordance with a preferred embodiment for cases where great flexibility is desirable, of a mattress of elastic cellular material having appropriate passageways therethrough.

However, in the latter-mentioned preferred form of embodiment, such mattress is not subjected to permanent crushing as in prior art devices and its role in the suspension function is confined to a back-up role, such as for damping possible vibrations and contributing locally to matching the cushion to band surface unevennesses.

It should be noted that in prior art devices in which the cellular material is compressed, the thickness thereof cannot exceed more than 30% or 40% of the width, for otherwise an unstable shape would result that would be liable to displace the cushion laterally in either direction along the drum axis and thereby dissociate it from the band to be pressed. In the subject device of this invention, the thickness of the elastic cellular mattress can be uniquely determined by the maximum degree of freedom it is desirable to allow the taut flexible strip to enable it to assume a configuration matching the contour over which the fluid cushion is applied.

Obviously, the cellular mattress must be flexible in relation to the longitudinal stiffness of the strip (which, though great, cannot be infinite) in order to ensure that the greater part of the cushion load is transmitted by the strip.

The flexible strip is preferably made of a relatively inextensible material like metal (e.g. stainless steel, beryllium bronze, etc..) or a woven material or composite fibre material (including, for example, carbon or boron fibres buried in the plastic binding material).

That surface of the active section of the strip which is adjacent the free face of the band can be covered with advantage with a flexible coating such as a coating of a bonded plastic having a low coefficient of friction in respect of said band. Such coating performs a protective function in the event, say, of local inadequacies in the fluid cushion or cushions.

The flexible strip may be either of the open-ended or endless type. In either event, the elastic damping means possibly associated to it preferably have a very small amount of travel and may comprise cup washers or rubber rings cooperating with preferably adjustable stop means.

The present invention preferably provides for the use of a plurality of substantially independent cushions, each of which is fed through a passageway having a constricted section or a jet. Local pressure variations in a cushion are accordingly completely or near-completely prevented from being communicated to the pressure-fluid source through the corresponding jet and thus have very little effect on the flow to the other cushions, whereby a fluid film of sufficient depth is everywhere maintained.

The description which follows with reference to the accompanying non-limitative exemplary drawings will give a clear understanding of how the invention can be carried into practice.

Figure 4:
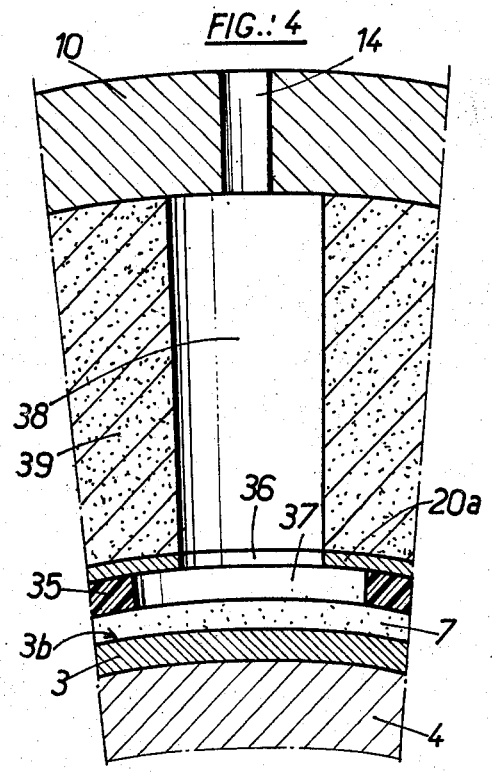
FIG. 4 illustrates a detail of FIG. 2 on an enlarged scale.
Figure 4A:
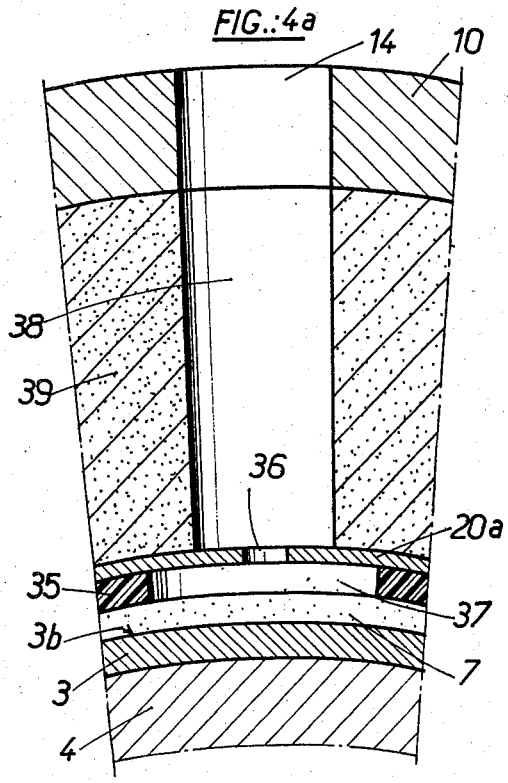
Figure 2:
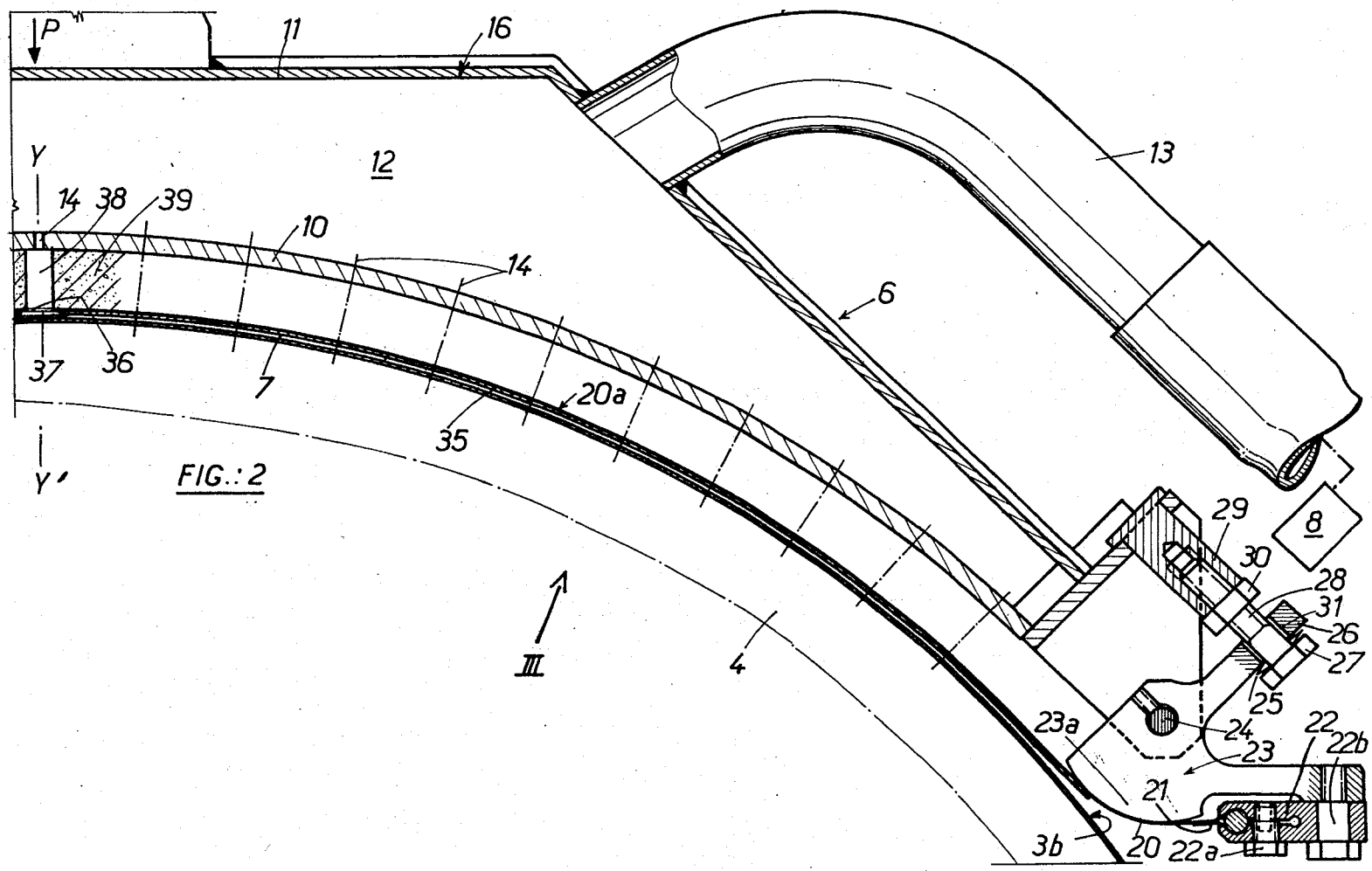
FIG. 2 shows diagrammatically in partial cross-section a pressure device according to a first embodiment of the invention.
Figures 5, 8:
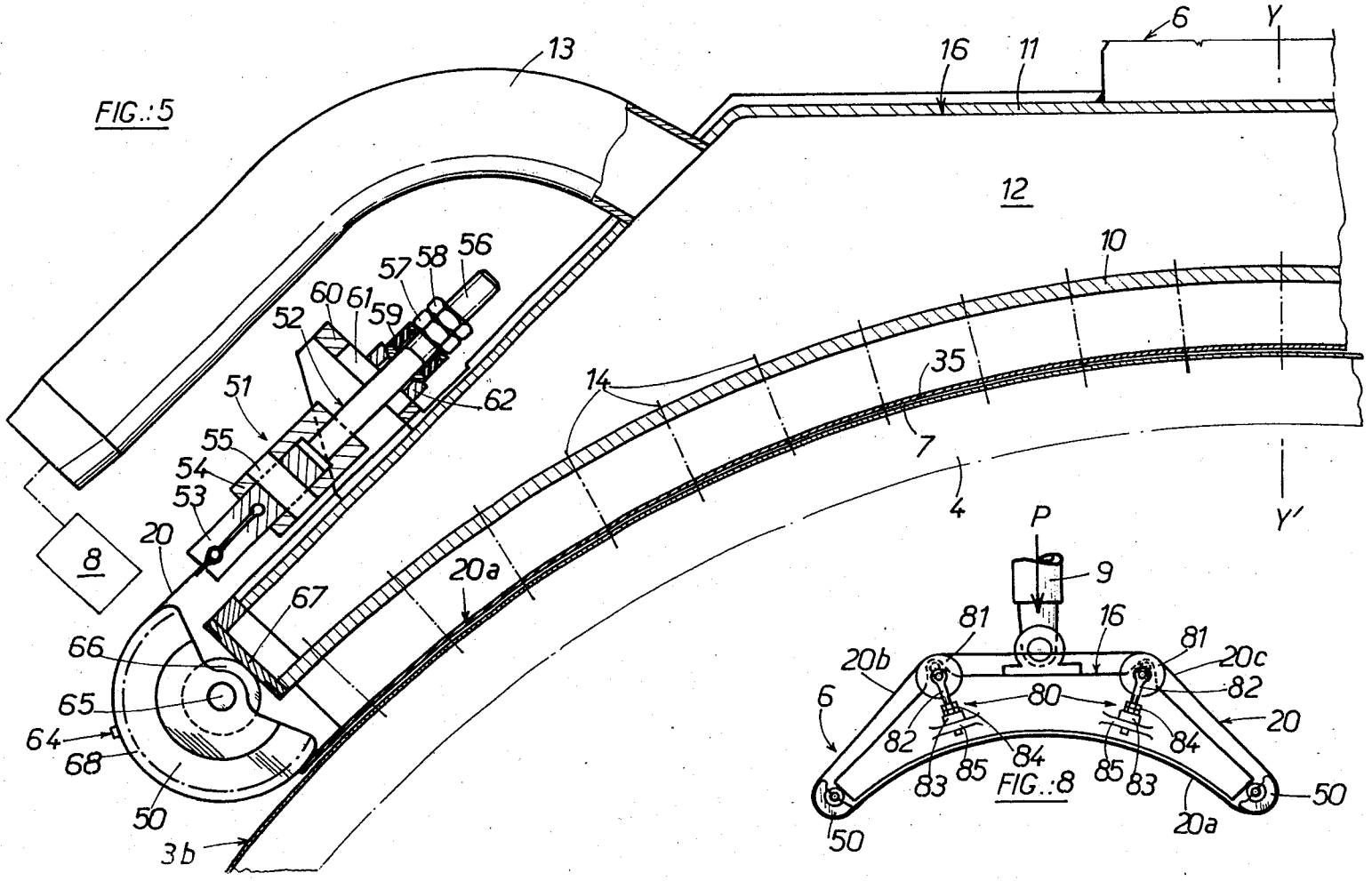
Figures 6, 6A, 7:
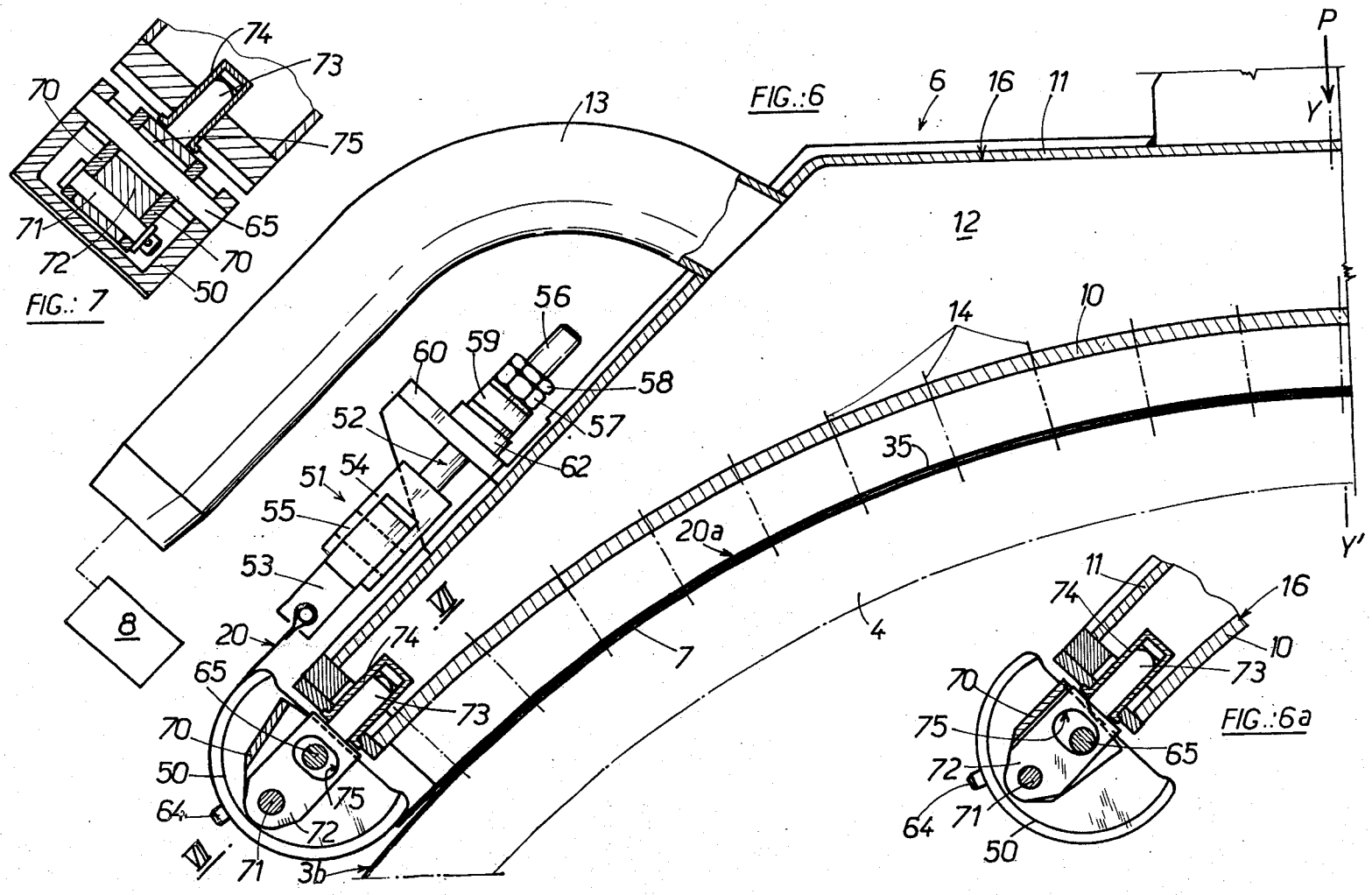

FIG. 4*a* is a view corresponding to FIG. 4, depicting a possible variant on the same detail;

FIG. 5 is a schematic illustration in partial cross-section of a pressure device according to a second embodiment of the invention;

FIG. 6 is a schematic view in partial cross-section of a pressure device according to a third embodiment of the invention;

FIG. 6*a* shows another position of part of the device shown in FIG. 6;

FIG. 7 is a sectional view taken through VII—VII of part of the device shown in FIG. 6; and FIG. 8 is a diagrammatic illustration in cross-section, on a smaller scale than in FIGS. 2,5 and 6, of a pressure device according to a fourth embodiment of the invention.

In all the drawings, like or equivalent parts are designated by like numerals.

Figure 1:
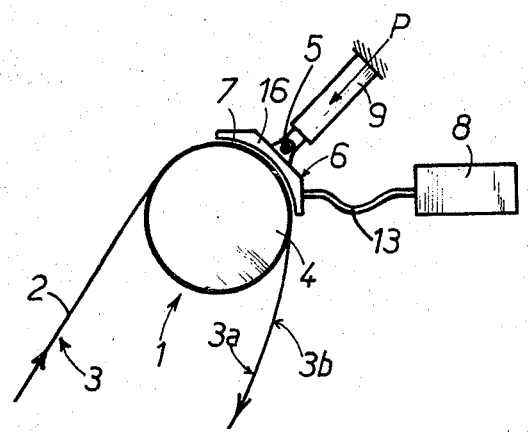
FIG. 1 is a schematic portrayal of band tensioning means comprising a pressing device according to this invention.

In FIG. 1, reference numeral 1 designates a tensioning device for setting under tension a selected portion 2 of a band 3 running past said device continuously.

Such tensioning device includes a cylinder 4 such as a roller, drum, pulley or the like, which is a driving or braking cylinder depending on its position in the installation. In FIG. 1 it is assumed that cylinder 4 is a driving cylinder.

The band 3 has an active face 3*a* which contacts the cylinder over a circumferential arc thereof, and a free opposite face 3*b*.

Associated to cylinder 4 is a pressure shoe 6 positioned opposite a portion of the free band face 3*b* and separated therefrom by a narrow gap 7 which constitutes a cushion space in which prevails at least one fluid cushion fed from a pressurized-fluid source 8. The arc embraced by the shoe may be of the order of 90°, for example.

The shoe 6 includes a rigid body 16 supported on a hinge or ball-joint 5 through which appropriate means such as a jack 9 allow exerting a radial thrust P towards the free band face. The hinge or ball-joint 5 is located substantially on the bisector of the arc embraced by the shoe. This thrust is transmitted to the band through the cushion or cushions 7 and causes it to be pressed against the outer surface of the cylinder 4, thereby to improve the driving or braking capacity. The present invention relates more particularly to the pressure shoe 6.

FIG. 2 illustrates a first form of embodiment of a pressure device according to the invention. Although only half of pressure shoe 6 is depicted on FIG. 2, it is to be understood that the other half is symmetrical thereto in relation to plane Y′–Y.

The rigid body 16 of shoe 6 has a hollow fluidtight structure formed by walls such as walls 10 and 11 bounding an interior chamber 12 which, through a flexible conduit 13, communicates with the pressurized fluid source 8 whereby to form a cushion fluid manifold or intake box.

Figure 3:
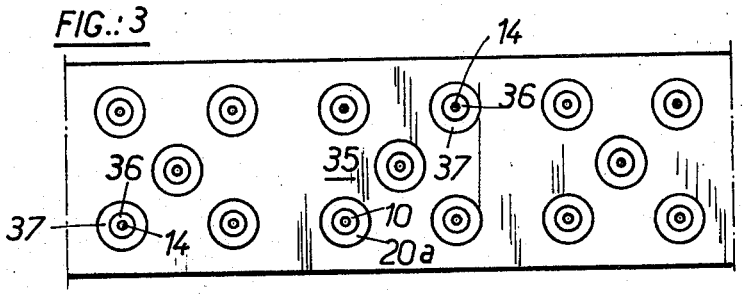
FIG. 3 is a partial view along the arrow III of the pressure device shown in FIG. 2.

The wall 10 of manifold 12 is formed with at least one but preferably a plurality of passageways 14 arranged as schematically indicated in FIGS. 2 and 3 and each of which communicates manifold 12 with a corresponding cushion space 7.

Passageways 14 each preferably include a jet-forming constriction, each of which is associated to a fluid cushion or cushion portion and thereby renders such cushion or cushion portion independent of the other cushions or cushion portions, this being due to the fact that pressure variations in a cushion or cushion portion are transmitted upflow to manifold 12 through the corresponding jet, either not at all or only slightly, and consequently do not affect the other cushions or cushion portions, thereby ensuring that a fluid film is maintained notwithstanding possible ripples in the band surface.

Mounted on rigid body 16 is a thin flexible strip 20 having an "active" section 20*a* facing the free face 3*b* of the band to be pressed and two ends 21 located symmetrically in relation to the plane Y′–Y.

Each end 21 is secured by means of a clamp 22 which can be tightened by a bolt 22*a* and which is itself hingedly supported by a pin 22*b* to adjustment means which, in the illustrated example, include a lever or bell-crank 23 pivotally supported on a pin 24 carried by said rigid body. Bell-crank 23 is formed with a rounded portion 23*a* over which the terminal portion of strip 20 bears.

An elastic damping member, which in the illustrated example includes a pair of cup-washers, is interposed between one arm 26 of bell-crank 23 and a stop 27 fast with the rigid body of shoe 16. Such stop may consist of the head of a threaded bolt 28 screwed into a part 29 fast with rigid body 16 and locked in position by a nut 30. The position of stop 27 can thus be adjusted by slackening nut 30 and screwing the bolt 28 in or out.

The bolt 28 extends freely through a bore 31 formed in arm 26, whereby the latter is able to slide freely over said bolt.

In the illustrated example, the strip 20 is made of a material which is at once relatively inextensible and very flexible to enable it to hug any surface unevennesses in the moving band 3. Such strip may be made, for example, of a thin sheet of beryllium bronze or stainless steel with a thickness of, say, about 0.15 mm. Alternatively, it could be made from a sheet of near-inextensible plastic, or of a woven or composite fibre material consisting, for instance, of carbon or boron fibres buried in a plastic binder such as synthetic resin.

That face of strip section 20*a* which faces the free band face 3*b* may be covered with a coating 35 (see also FIG. 4) made of a material having a low coefficient of friction with respect to said band. Such coating may consist, for example, of a flexible sheet of plastic bonded to said active strip section. Preferably, the elastic characteristics of such sheet and adhesive are chosen so as not to comprise the suppleness of the active strip section 20*a*. The sheet of plastic may be made, for example, of polyamide or polytetrafluorethylene and may be in the region of 0.5 mm to 1mm thick.

To each of the passageways 14 formed through the wall 10 of manifold 12 corresponds, in an alignment thereof, a passageway 36 formed through the active strip portion 20*a* and a passageway 37 formed through the anti-friction coating 35. As shown in FIG. 4, passageway 37 is preferably widened whereby to form a chamber which, jointly with the free band face 3*b*, bounds one of the said cushion portions 7. The passageways 14 and 36 are interconnected through a deformable conduit 38.

In the illustrated example, a mattress 39 of elastically deformable cellular material based on rubber or an elastomer, is interposed between the active strip section 28 and the wall 10 of manifold 12. Such mattress may be bonded to such active portion and said wall to advantage, in which case the said deformable conduits 38 are formed by passageways provided through the thickness of said mattress, in alignment with the other passageways 14, 36 and 37.

Because passageway 14 serves as a jet, the other passageways 36 and 38 have a larger section. However, it goes without saying that this particular disposition is by no means the only possible one. Thus FIG. 4*a* shows an alternative embodiment in which the jet is in effect the passageway 36 formed through the active strip section 20*a*.

The pressure device hereinbefore described functions in the following manner:

In the inoperative configuration, that is to say when pressure shoe 6 is not applied against the free face 3*b* of band 3 responsively to the pressing thrust P, the adjustment systems 25, 26, 27, 28, 29, 30 exert upon flexible strip 20, through the agency of bell-cranks 23, a minimum pull which is balanced by the reaction of cellular material 39. The essential purpose of this initial tension is to take up the curvature in the free portions of the flexible strip 20 and thereby limit its elasticity solely to its degree of stiffness under tension during operation and cause it to withstand virtually the entire load applied. If this precaution were not taken, the curvature take-up process would occur when the system is set under load and could cause the cellular material 39 to be crushed in excess of the limit determined by its characteristics mentioned precedingly.

Another reason why the member 25 must possess great and clearly specified stiffness is in order to limit the apparent extension of the flexible strip under load. In particular, its interposition enables a possible necessary damping effect to be introduced.

A very light initial tensioning of the flexible strip is enough to take up the curvatures in its free portions. This is an advantage because such tensioning sets the cellular material 39 under tension and hence also the adhesiveness existing between it and strip 20, a tensioning effect which it is preferable to limit.

When the shoe 6 is applied against the free face of band 3 responsively to the pressing thrust P exerted against the rigid body of shoe 16, the active strip section 20*a* matches its arcuate shape to that of a portion of said free band face. The strip 20 as a whole then tautens and exerts a force on the two arms of bell-crank 23, which force is balanced by the restraining system 25. 26. 27. 28. 29. 30.

The pressing effect is transmitted to the band through the fluid cushion or cushions 7 supplied from fluid manifold 12 via passageways 14-38-36-37. In the event of a local inadequacy in one or more of these cushions, or a failure in the feed system, flexible strip 20 bears against the band 3 through the anti-friction coating 35, thus reducing the risk of damaging the band due to friction.

Strip 20 is flexible enough to be able to follow surface unevennesses on the band 3, and most at least of the latter's motions are absorbed by the elastic members 25. In this respect it is preferable to select elastic members having substantial internal damping capacity, such as cup washers, rubber rings or the like. However, it goes without saying that the elastic damping members 25 could be dispensed with and only the means for adjusting the useful length of the active strip section 20*a* retained in cases where surface ripples or corrugations in the band are not excessive.

Thus it will be appreciated that only a very small part of the continuous pressing thrust P is transmitted to band 3 through cellular mattress 39 which is therefore not subjected to permanent crushing. In addition to its prime function, which is to act as a support for the deformable conduits 38 which feed the fluid cushions 7, it accordingly performs only an accessory back-up function by means of which unexpectedly larger surface unevennesses in the bands 3 can be filtered out for example. The useful life of the mattress is consequently considerably extended.

There is thereby provided a band pressing device equipped with an efficient suspension device, in which the disadvantages stemming from the use of an intermediate mattress working in compression are eliminated.

FIG. 5 illustrates an alternative embodiment of a pressing device according to this invention.

Broadly speaking, this device is similar to the one hereinbefore described with reference to FIGS. 2 through 4*a*, from which it differs only in certain particularities relating to the method of attaching the flexible strip 20 to the rigid body of shoe 16.

In this alternative embodiment, flexible strip 20 runs over two intermediate members 50 before being fastened at each end to an adjusting member 51. Only one of the two intermediate members and one of the two adjusting members are shown on FIG. 5, which represents a symmetry plane Y'–Y. The two intermediate members 50 are mutually spaced by a distance corresponding to the length of the active strip section 20*a*.

In the illustrated example, each of the two adjusting members 51 includes a part 52 which is translatable relative to the rigid body of shoe 16. This movable part in turn comprises a clamp 53 to which the corresponding end of strip 20 is secured, a clevis 54 to which clamp 53 is hinged about a pin 55, and a threaded rod 56 having one end welded to said clevis. The other end of rod 56 carries a nut 57 which forms an adjustable stop and which can be restrained in position by a locknut 58.

An elastic damping member 59 which, in the illustrated example, includes a rubber ring or bush, is interposed between adjustable stop 57 (fast with movable part 52) and a backstop 60 fast with the rigid body of shoe 16. This backstop has a hole 61 extending through it to enable the rod 56 to slide freely through it axially. A cup washer 62 may be interposed with advantage between backstop 60 and member 59.

For the same reasons as precedingly, elastic damping member 59 has a very small degree of travel and could even be dispensed with if the ripples in the band are not excessive.

Apart from constructional differences, the manner of operation of the two adjusting members 51 is the same as that of the two adjusting members 23 described with reference to FIG. 2.

Each of the two intermediate members 50 comprises a pulley sector around the periphery of which the flexible strip 20 is wrapped. A locating peg 64 carried by said pulley sector enables the latter to be correctly positioned in relation to the corresponding end of flexible strip 20.

In order to avoid any risk of rough contact between the pulley sector and band 3 that could damage the latter, the pulley sector may be floatingly supported in relation to the rigid body of shoe 16.

Accordingly, each of the two pulley sectors 50 is supported on an axle 65 which bears against a radial surface 67 fast with the rigid body of shoe 16 through the agency of a roller 66 or a slipper.

At least one of intermediate members 50 may have its periphery coated with an elastic damping lining 68 made for example of rubber or an elastomer, upon which flexible strip 20 bears. This lining exerts upon the strip a force which may be complementary to or which may replace the force provided by the elastic damping members 59. A lining of the same kind could be provided on the radial surface 67 against which roller 66 bears.

FIGS. 6, 6*a* and 7 illustrate a third possible embodiment of the invention that differs from the precedingly described embodiment only in respect of a particularity relating to the floated mounting of the two pulley sectors 50 with respect to the rigid body of shoe 16.

In this embodiment, each of the two pulley sectors 50 is associated to a supporting structure which includes the pulley axle 65 and two links 70 traversed thereby. The assembly 65–70 is pivotally mounted about a pin 71 carried on a mount 72 which is in turn pivotally supported on a second pin 73 rotatably supported in a bearing 74 carried by the rigid body of shoe 16. As shown in FIG. 6, the mount 72 is formed with an opening 75 of oblong section which enables the axle 65 of pulley sector 50 to shift transversely in relation to said opening. Supporting pin 65 and the pulley sector 50 it carries can accordingly describe pivotal motion about the two mutually perpendicular pins 71 and 73 carried by the rigid body of shoe 16. FIGS. 6 and 6*a* show two different positions occupied by pulley sector 50.

As in the previously described embodiment, this floating assembly allows avoiding rough contact between the portion of flexible strip wrapped around pulley sector 50, and the band 3. Adjustment by rotation about the pin 73 further enables the pulley sector to adapt to possible widthwise tilting of the band 3. This arrangement offers the added advantage, by comparison with the arrangement in FIG. 5, of enabling the intermediate members 50 to be maintained in position even in the event of absence of tension in flexible strip 20.

FIG. 8 schematically illustrates a fourth embodiment of a pressing device according to this invention, in which flexible strip 20 is an endless strip.

Such endless strip runs over two intermediate members 50 (of the kind described with reference to FIGS. 5 and 6, for example) which bound between them the active strip section 20*a*.

To this strip are associated at least one but preferably two adjusting members 80 which are movable relative to the rigid body of shoe 16 and each of which cooperates with a section 20*b* (or 20*c*) of the strip, thereby to create a degree of sag in the said section.

Each of these adjusting members may include an intermediate pulley 81 over which the strip 20 runs and which is supported by a rod 82 adjustable relative to the rigid body of shoe 16 by means of adjusting means 83 locked by a nut 84 against a stop 85 fast with the rigid body 16. In ths particular embodiment, no elastic member is provided but the same may be added if necessary.

Apart from constructional differences, operation of the pressing device shown in FIG. 8 is similar to that of the device described in detail with reference to FIG. 2.

It goes without saying that changes and substitutions of parts may be made in the exemplary embodiments described hereinabove without departing from the scope of the invention.

We claim:

1. In combination with a band running over the outer surface of an operative rotary cylinder and having an inner cylinder-engaging side and an outer free side, a pneumatically-acting band-pressing device for enhancing adhesion of said inner band side to said cylinder surface by means of a cushion-developing shoe urged towards said cylinder and separated from said outer band side by a narrow cushion space in which a fluid cushion builds up against said outer band side upon supply of pressure fluid to said shoe to press said band against said cylinder thereby increasing the contact engagement of said inner band side with said cylinder surface, said cushion-developing shoe comprising:

a rigid box-like body having two arcuately-spaced ends adjacent to said cylinder surface though radially spaced therefrom, and a ported wall extending between said ends, said ported wall being designed to be traversed in operation by said pressure fluid for cushion development, a flexible strip supported by said two ends and having an active ported section extending opposite and adjacent to said outer free side of said band, said flexible strip bounding with said outer band side said narrow cushion space which is designed to be fed with pressure fluid through said ported shoe wall and said ported strip section.

2. Device as claimed in claim 1, further comprising adjusting means for stretching said flexible strip section between said shoe ends.

3. Device as claimed in claim 2, wherein said flexible strip ends have two extremities respectively clamped to said shoe ends which are associated with said adjusting means for stretching said flexible strip section.

4. Device as claimed in claim 2, wherein said flexible strip is an endless strip extending around said shoe body and engaged by said adjusting means for stretching said flexible strip section.

5. Device as claimed in claim 2, further comprising resilient damping means cooperating with both said flexible strip and said rigid body.

6. Device as claimed in claim 5, wherein said resilient damping means comprises at least one short-stroke elastic damping member associated with said adjusting means for stretching said flexible strip section, said member being interposed between a portion fast with said adjusting means and a portion fast with said rigid body.

7. Device as claimed in claim 5, wherein said shoe comprises two intermediate members which are arcuately spaced from each other by a distance coextensive with said active strip section and over which said flexible strip runs, a structure associated with each intermediate member for supporting the same, and linking means between said supporting structure and said rigid body whereby to allow said supporting structure to move to a limited extent relatively to said rigid body.

8. Device as claimed in claim 2, wherein said resilient damping means comprises a rubberlike lining over at least one of said intermediate members, said flexible strip bearing upon said lining.

* * * * *

UNITED STATES PATENT AND TRADEMARK OFFICE

CERTIFICATE OF CORRECTION

PATENT NO. : 3,999,633

DATED : December 28, 1976

INVENTOR(S) : Jacques F. R. PROUHET

It is certified that error appears in the above-identified patent and that said Letters Patent are hereby corrected as shown below:

Column 10, (claim 8) line 20, "claim 2" should read -- claim 7 --

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*